US005379752A

United States Patent [19]

Virgil, Jr. et al.

[11] Patent Number: 5,379,752

[45] Date of Patent: Jan. 10, 1995

[54] LOW SPEED INTERLOCK FOR A TWO STAGE TWO SPEED FURNACE

[75] Inventors: Hall Virgil, Jr., Brownsburg; Ninev K. Zia, Indianapolis; Daniel J. Dempsey, Carmel, all of Ind.

[73] Assignee: Carrier Corporation, Syracuse, N.Y.

[21] Appl. No.: 90,332

[22] Filed: Jul. 12, 1993

[51] Int. Cl.[6] ..... F24H 3/00

[52] U.S. Cl. ..... 126/116 A; 126/116 R; 431/62

[58] Field of Search ..... 126/116 A, 116 R; 431/62, 90, 19, 20; 236/15 C, 45

[56] References Cited

U.S. PATENT DOCUMENTS 4,688,547 8/1987 Bollard et al. ..... 126/110 R X
4,729,207 3/1988 Dempsey et al. ..... 126/110 R X
4,962,749 10/1990 Dempsey et al. ..... 126/110 R X
4,976,459 12/1990 Lynch .
4,982,721 1/1991 Lynch .
5,027,789 7/1991 Lynch .

*Primary Examiner*—Larry Jones

[57] ABSTRACT

A two-stage induced draft furnace is operated at either high heat or low heat with the gas valve switched to high-fire or low-fire. High-fire and low-fire combustion pressure switches sense the collector box flue gas pressure and actuate respective solenoids of the gas valve. Under some conditions the inducer can produce sufficient negative pressure at low fire to prove the high fire pressure switch and cycle the burners on high fire. To prevent this, relay contacts are interposed between the high fire pressure switch and the gas valve solenoid to deny thermostat power to the high-fire solenoid whenever there is a call for low heat.

4 Claims, 3 Drawing Sheets

LOW SPEED INTERLOCK FOR A TWO STAGE TWO SPEED FURNACE

BACKGROUND OF THE INVENTION

This invention is directed to space heating furnaces, and is more particularly concerned with induced combustion type two-speed gas furnaces.

In a conventional furnace for heating of a residential or commercial space, a thermostat senses that the temperature of an interior comfort space is below a set temperature, and closes to call for heat. The call for heat applies thermostat voltage to the furnace to turn on a gas burner, and, after a predetermined blower-on delay time, to turn on the circulation air blower. The gas burner, which operates at a single rate, injects flame and heated gas into a heat exchanger, which heats the circulation air that is then returned to the interior space. An induced combustion fan draws combustion gases through the heat exchanger and exhausts them into a vent pipe for discharge to the outside environment. Heating continues until the thermostat senses that the interior room air has been heated above the set point, at which time it opens and ends the call for heat.

More recently, two-speed furnaces have been proposed. These have gas burners which can operate at a full flow rate or high fire and can also operate at partial flow rate or low fire. The high fire mode is employed when there is a high demand for heating, that is, when the differences between interior temperature and set point temperature is relatively great. The low fire mode is employed when there is a lower demand for heat, that is when the difference between interior temperature and set point temperature is relatively small. A logic unit, such as a pre-programmed microprocessor, can be employed to actuate the burners in the low- or high-fire modes.

The gas burners can be actuated into the low fire and high fire modes in response to a low-fire combustion pressure switch and a high-fire combustion pressure switch, which sense the negative pressure in the furnace combustion chamber. These serve to turn the burners on only if the inducer fan is bringing enough combustion air in to support the low heat or high heat burner mode. The inducer fan can employ a two-speed motor, typically a two-speed shaded-pole or permanent-split-capacitor ac motor.

Under varying conditions of electrical voltage, and depending on vent design, changing atmospheric conditions, and other variables, the low speed operation of the inducer motor can create enough negative pressure to also actuate the high-fire combustion pressure switch. When this switch is energized, the furnace gas burners go to the high heat mode. However, the inducer and blower remain at their lower speeds. Thus, this produces an non-optimal, and possibly unreliable condition.

OBJECTS AND SUMMARY OF THE INVENTION

Accordingly it is an object of this invention to provide a furnace which overcomes the drawbacks of the prior art.

It is another object to provide a furnace which is stably actuable into high-fire and low-fire modes notwithstanding variations in line voltage or design deviations in the vent stack construction.

According to an aspect of the invention, a gas-fired furnace has burners that are operable in a low-fire and a high-fire mode. The mode is selected by the vacuum pressure at the exit of the furnace heat exchangers as induced by multi-speed inducer. An interlock relay is interposed in series between the high-fire pressure switch and the high-fire solenoid of the burner gas valve. This prohibits the high-fire solenoid from being energized when the furnace is in a low-fire mode. The interlocking relay contact is connected in the high pressure switch circuit. This relay can be normally open and energized only if there is a call for high heat, or else can be normally closed and opened by a call for low heat. In either event, the result is to deny twenty-four volt thermostat power to the high-fire solenoid whenever there is call for low heat.

The above and many other objects, features, and advantages of this invention will become apparent to those skilled in the art from the ensuing description of a preferred embodiment, with reference to the accompanying Drawing.

BRIEF DESCRIPTION OF THE PREFERRED EMBODIMENT

DETAILED DESCRIPTION OF THE PREFERRED EMBODIMENT

Figure 1:
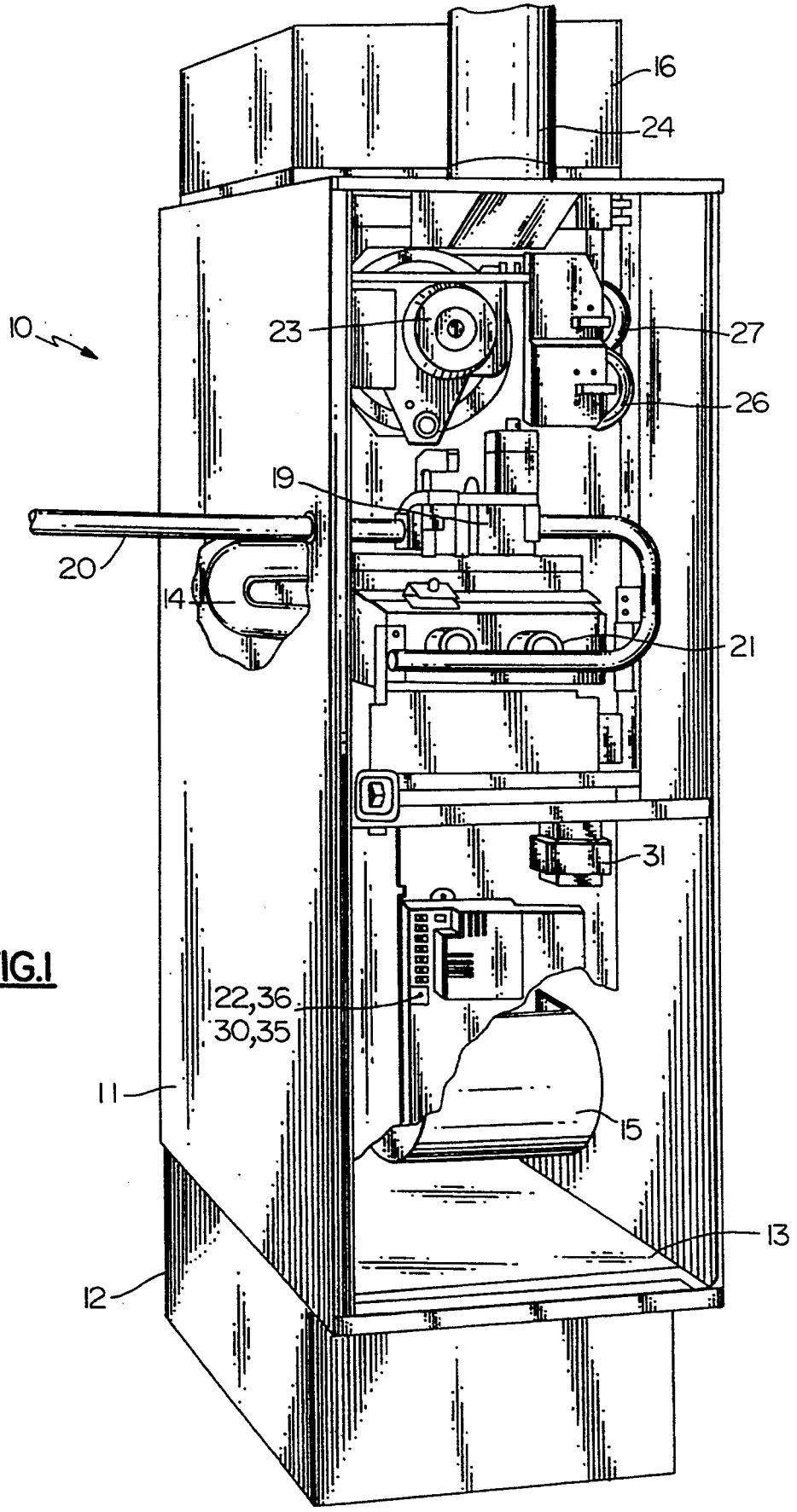
FIG. 1 is a perspective view of a two-speed induced type furnace which incorporates the features of a preferred embodiment of this invention.

With reference to the Drawing, and initially to FIG. 1, a modern residential gas-fired furnace 10 is of the two-stage type housed within a cabinet 11. The furnace is here shown in an upflow configuration, with cool return air from the heated interior comfort space passing through a cold air return duct 12 and through a filter 13 into the lower part of the furnace from which it is forced into and through a heat exchanger 14 by means of a multi-speed blower 15. The circulation air is heated by the heat exchanger 14 and then passes into a warm air plenum 16, from which it moves through suitable ductwork back into the interior comfort space.

The heat exchanger 14 is of a design into which hot combustion gases are injected. A secondary or condenser type heat exchanger stage may also be incorporated. Combustion air is supplied to one or more gas burners. An air intake pipe (not shown) can be employed in some furnaces. The burners inject flame and hot combustion products into the heat exchanger. A gas valve 19 has an inlet connected to a gas pipe 20 to a source of natural gas, propane, or other suitable fuel gas, and an outlet side that feeds the burners 21, one of which is shown here.

A control box 22 within the furnace supplies signal and power to the gas valve 19 through a low-fire gas pressure switch 27 and also to the draft inducer motor 23. The control box can typically incorporate a programmed microprocessor to operate the furnace so as to achieve optimum comfort at as high efficiency as possible. The inducer is positioned on the exhaust side of the heat exchanger 14 to draw the combustion product gases out therefrom. These are exhausted into a vent pipe 24 which carries them outside the building.

A high-fire gas pressure switch 26 and a low-fire gas pressure switch 27 are mounted near the draft inducer 21. These are in gas pressure communication with the flue gases in the collector box at the outlet of the heat exchangers, and are electrically coupled to respective solenoids of the gas valve 19.

The gas valve 19 is actuable at two speeds or flow rates. That is, in addition to shut off and full flow rate or high fire, the gas valve is also actuable at an intermediate flow rate or low-fire.

Figure 2:
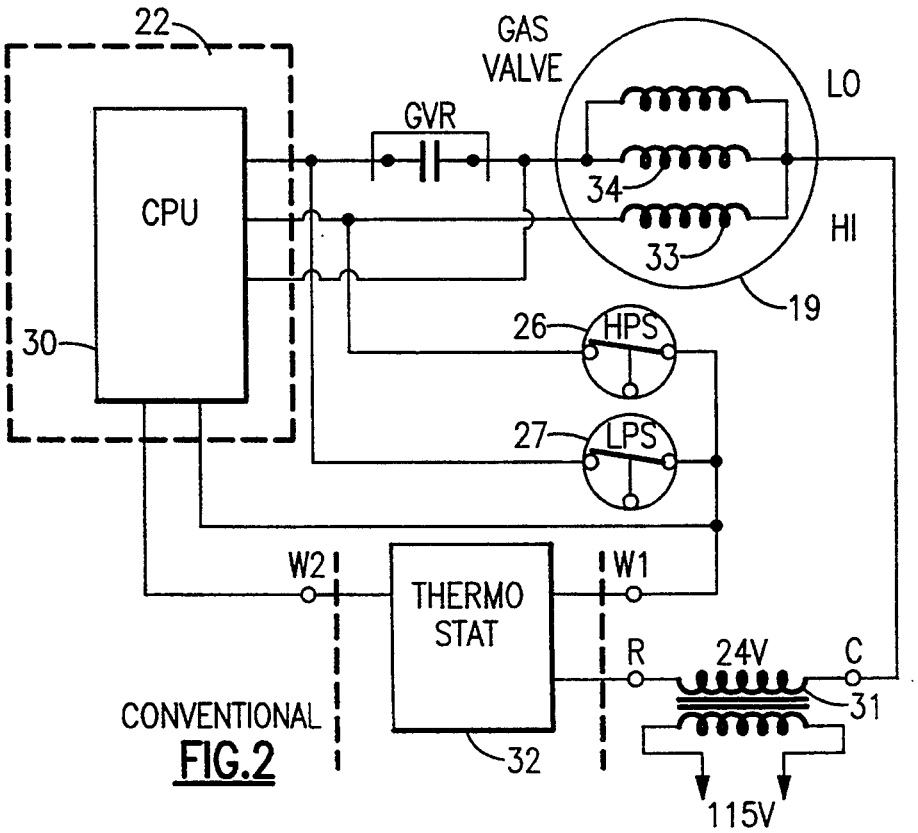
FIG. 2 is a schematic circuit diagram of the high-fire and low-fire pressure switches and gas valve solenoid according to a conventional design.

As shown in FIG. 2, in a furnace of this type and of a conventional configuration, the actuation and mode of the gas valve 19 is controlled by the pressure switches 26 and 27. That is, when there is a call for heat, the inducer motor is energized, and the combustion air flow induced by the inducer 23 is sensed by the pressure switches 26,27. Inducer motor speed is selected at low speed or high speed to select the low-fire or high-fire mode for the burners 21. As shown in FIG. 2, the control box 22 includes a microprocessor 30 which actuates and selects the speeds of the blower motor and inducer motor, and which determines, based on temperature parameters, whether the high-fire or the low-fire mode is needed.

A thermostat 32 is here shown connected to W1 and R conductors, and closes a circuit that includes a 24-volt transformer secondary 31 to supply thermostat power to the high-fire pressure switch 26, the low-fire pressure switch 27, and the high-fire and low-fire solenoids 33,34 of the gas valve 19.

When the inducer achieves the proper pressure in the collector box for low fire, the low-fire pressure switch 27 proves low fire air flow and actuates the low-fire solenoid 34. When high-fire is called for and the pressure is proper for high-fire pressure switch 26 to prove high fire air flow the switch 26 actuates the high fire solenoid 33.

Under some low-fire operating conditions, it is possible for the inducer to produce enough pressure to prove the high fire combustion pressure switch 26, and set the burners 21 on high fire. This can be aggravated under high voltage conditions (i.e., line voltage above 115 vac) or where the pipes 24 are rather short. High fire under these conditions should be avoided because the excessive heat can damage the heat exchanger. The blower 15 operates at reduced flow rate during a call for low fire, and that may be insufficient to prevent an excessive temperature rise in the heat exchanger.

Figure 3:
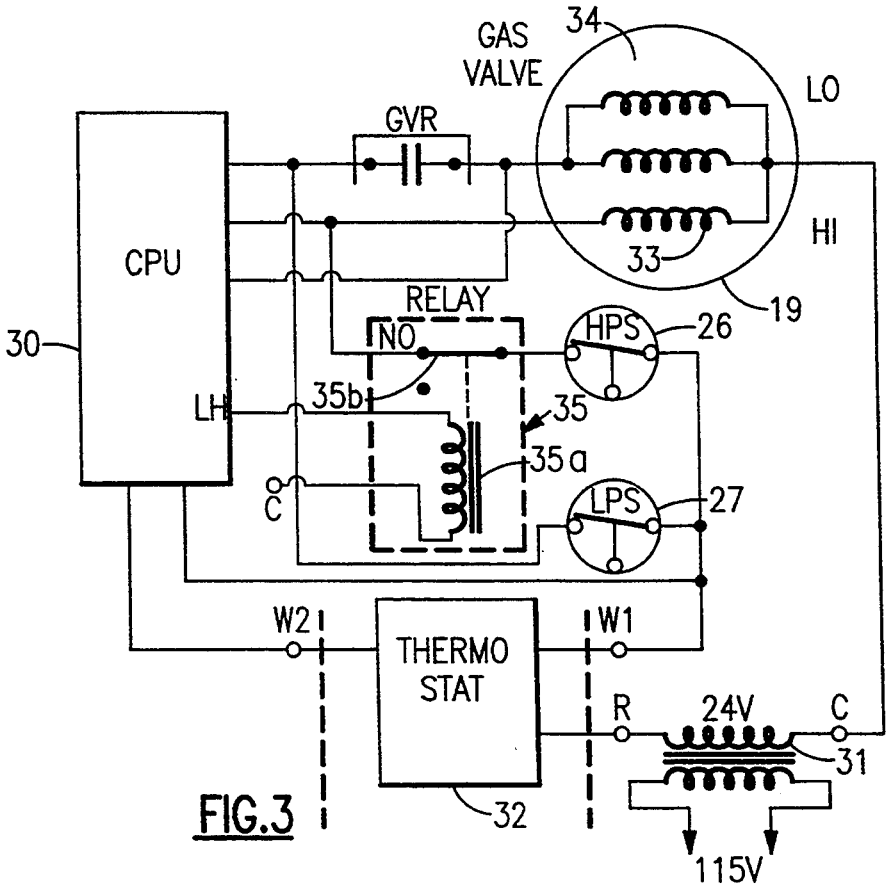
FIG. 3 is a schematic circuit diagram according to one preferred embodiment of the invention.

A proposed solution to this problem is shown in FIG. 3, in which the same elements illustrated in FIG. 2 are identified with the same reference numbers. Here, a relay 35 is shown with its coil 35a actuated by the microprocessor 30 when there is a call for low heat. A normally-closed contact **35*b* is interposed in series between the high pressure switch 26 and the high fire solenoid 33 of the gas valve 19. The contact 35*b*** opens when there is a call for low heat, so that the burners cannot go into a high-fire mode during a time the furnace is in a low-fire mode.

Figure 4:
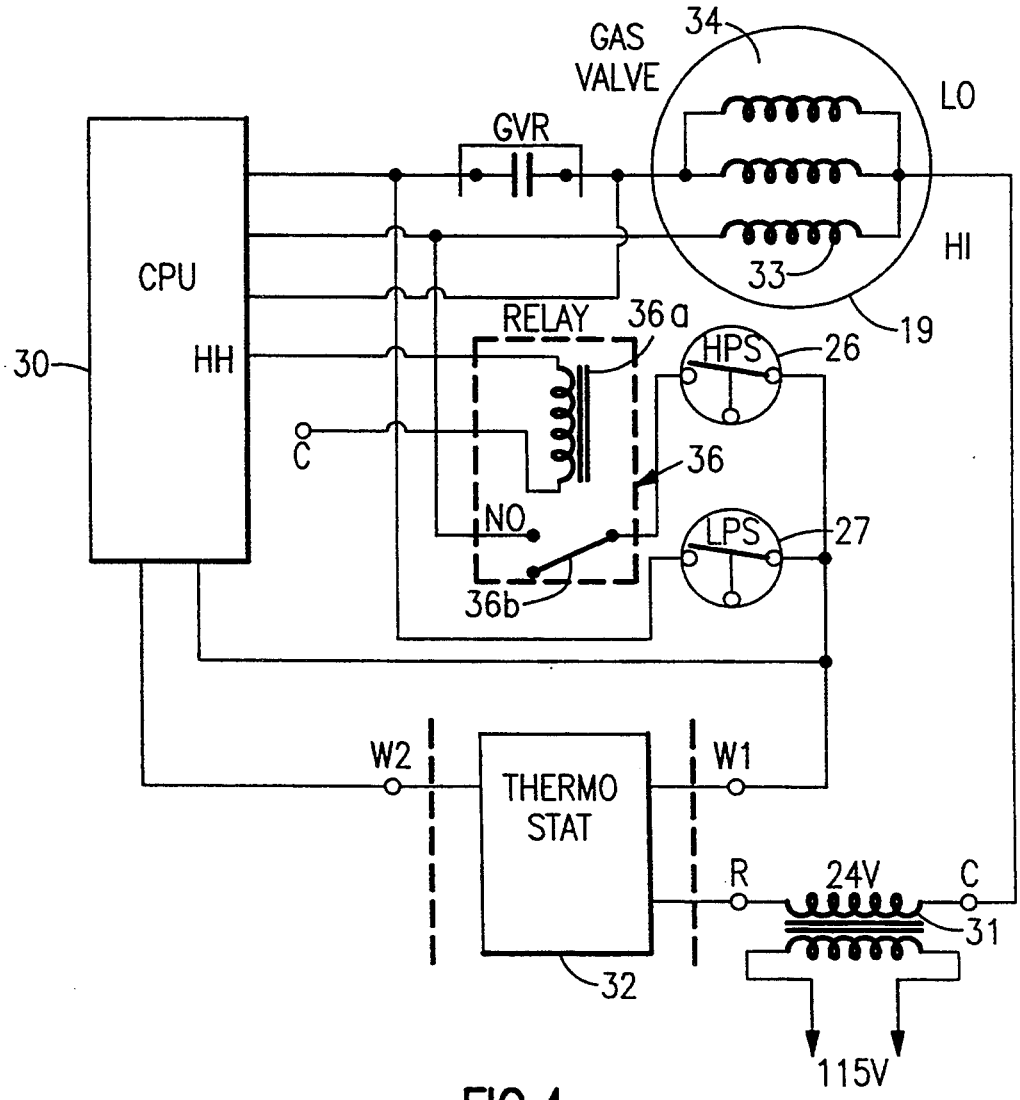
FIG. 4 is a schematic circuit diagram according to another embodiment of the invention.

An alternative solution is shown in FIG. 4, in which the same elements shown in FIG. 2 are again identified with the same reference numbers.

Here a relay 36 has its coil **36*a* actuated by the microprocessor 30 when there is a call for high heat, and has a normally open contact 36*b* in series with the pressure switch 26 and the high-fire solenoid 33. This configuration prohibits the gas valve 19 from switching to high fire except when there is a call for high heat; that is, the solenoid 33** cannot be energized if there is a call for low heat.

In either FIG. 3 or FIG. 4, or in many other possible variations, the twenty-four volt thermostat power is denied to the high-fire solenoid 33 whenever there is a call for low heat.

While the invention has been described in connection with selected preferred embodiments, it should be understood that these are examples of many possible embodiments, and that many modifications and variations would occur to those skilled in the art without departing from the scope and spirit of this invention, as defined in the appended claims.

What is claimed is:

1. In a gas-fired forced air furnace for heating air in a comfort space and in which at least one gas burner is disposed in a combustion chamber that is supplied with combustion air and which supplies heated combustion gases to a heat exchanger for heating circulation air that passes through the heat exchanger and returns to the comfort space, in which an electrically actuated gas valve supplies fuel gas to said at least one gas burner and is actuable into a cutoff mode, a partial-flow low-fire mode, and a full-flow high-fire mode, the gas valve having a low-fire input and a high-fire input; and in which a low-fire pressure switch in gas pressure communication with said collector box is operative to connect electrical power to said gas valve low-fire input when said collector box pressure attains a first predetermined pressure level and a high-fire pressure switch in gas pressure communication with said collector box is operative to connect electrical power to said gas valve high-fire input when said collector box pressure attains a second predetermined pressure level; the improvement which comprises interlock means connected in series with said high fire pressure switch to deny electrical power to said gas valve high-fire input when said gas valve is actuated in its low-fire mode in response to a call for low-fire.

2. The improved gas-fired furnace of claim 1 wherein said interlock means includes a relay having contacts in series with said high-fire pressure switch.

3. The improved gas-fired furnace of claim 1 wherein said furnace further comprises an inducer fan for forcing a flow of exhaust gases from said heat exchanger through an exhaust vent.

4. The improved gas-fired furnace of claim 3 wherein said inducer fan is operative at first and second fan speeds in respective low-fire and high-fire operating modes.

* * * * *